US007536878B2

(12) United States Patent
Kosui

(10) Patent No.: US 7,536,878 B2
(45) Date of Patent: May 26, 2009

(54) METHOD FOR KNITTING DOUBLE TUBULAR FABRIC

(75) Inventor: Tatsuya Kosui, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 27 days.

(21) Appl. No.: 11/722,990

(22) PCT Filed: Dec. 26, 2005

(86) PCT No.: PCT/JP2005/023810

§ 371 (c)(1),
(2), (4) Date: Jun. 27, 2007

(87) PCT Pub. No.: WO2006/070758

PCT Pub. Date: Jul. 6, 2006

(65) Prior Publication Data

US 2008/0134725 A1 Jun. 12, 2008

(30) Foreign Application Priority Data

Dec. 28, 2004 (JP) ..... 2004-382109

(51) Int. Cl.
*D04B 1/28* (2006.01)

(52) U.S. Cl. ..... 66/64; 66/176

(58) Field of Classification Search ..... 66/64, 66/69, 70, 172 R, 175, 176, 177, 183
See application file for complete search history.

(56) References Cited

U.S. PATENT DOCUMENTS 2,659,893 A * 11/1953 Hindman ..... 2/212
2,926,512 A * 3/1960 Robertson ..... 66/178 R
3,678,514 A * 7/1972 Safrit ..... 2/212
5,052,058 A * 10/1991 Mueller ..... 2/228
5,136,727 A * 8/1992 Brisco ..... 2/409
6,354,114 B1 3/2002 Sghiatti (Continued)

FOREIGN PATENT DOCUMENTS

JP 61-27502 B2 6/1986

(Continued)

*Primary Examiner*—Danny Worrell
(74) *Attorney, Agent, or Firm*—Rothwell, Figg, Ernst & Manbeck, P.C.

(57) ABSTRACT

The present invention provides a method of knitting a double tubular knitted fabric in which an outer tubular section can be formed independent from an inner tubular section while knitting the inner and outer tubular sections simultaneously by a flat knitting machine. Each of the front knitted fabric parts of the inner and outer tubular sections is assigned to one of the front and back needle beds, and each of the back knitted fabric parts of the inner and outer tubular sections is assigned to the other needle beds. The knitting method uses at least two yarn feeders, where the inner tubular section is formed using a yarn from one yarn feeder and the outer tubular section is formed using a yarn from the other yarn feeder. In knitting the outer tubular section, return knitting is performed where a loop is formed subsequent to the loop formed in a going course in a returning course. The outer tubular section is formed in the tubular form by connecting the loops at the boundary of the returning part. In knitting the inner and outer tubular sections, the respective yarn feeders are moved such that the yarns for knitting the inner and outer tubular sections do not intersect.

10 Claims, 7 Drawing Sheets

U.S. PATENT DOCUMENTS 6,446,470 B1 9/2002 Wu
6,550,288 B2 * 4/2003 Browder et al. ..... 66/177

FOREIGN PATENT DOCUMENTS

JP 2514489 B2 4/1996
JP 2880689 B2 1/1999
JP 2000-355859 A 12/2000
JP 3494487 B2 11/2003
JP 2004-292964 A 10/2004

* cited by examiner

METHOD FOR KNITTING DOUBLE TUBULAR FABRIC

CROSS REFERENCE TO RELATED APPLICATION

This application is a 35 USC § 371 National Phase Entry Application from PCT/JP2005/023810, filed Dec. 26, 2005, and designating the United States.

TECHNICAL FIELD

The present invention relates to a method of knitting a tubular knitted fabric having an inner tubular section and an outer tubular section by a flat knitting machine.

BACKGROUND ART

A method of knitting the knitted fabric having a double tubular structure in cross section by a flat knitting machine includes those disclosed in patent document 1 and patent document 2, for example.

According to the knitting method disclosed in patent document 1, knitting is performed in a manner that front and back knitted fabric parts of ribs, cuffs, and neckline of a sweater have double structure respectively in longitudinal section and a double tubular shape respectively in cross section. In the knitting method described in patent document 1, the inner tubular section and the outer tubular section are alternately knitted using one yarn feeder.

According to the knitting method disclosed in patent document 2, one part of the set up portion remains being held on a needle bed without knitting, and the set up portion is joined in the middle of the knitted fabric after knitting the knitted fabric in a tubular shape to a predetermined length. By knitting in this way, a pipe shaped portion is formed at the lower end of the tubular part, and a double tubular shape is formed in cross section.

Patent document 1: Japanese Patent No. 2514489

Patent document 2: Japanese Patent No. 3494487

DISCLOSURE OF THE INVENTION

Problem to be Solved by the Invention

However, in the knitting method disclosed in patent document 1, the yarns intersect at one end of the ends of the knitting width in the needle bed since the inner tubular section and the outer tubular section are alternately knitted. As a result, the inner tubular section and the outer tubular section are in a state of joining with each other at the position where the yarns intersect and the inner tubular section and the outer tubular section join from the top to the bottom of the tube at the intersecting portion of the yarns. That is, in the knitting method of patent document 1, it is impossible to knit a tubular knitted fabric in which the inner tubular section and the outer tubular section are completely independent, that is, the inner tubular section and the outer tubular section are not joined in the middle of knitting of the knitted fabric. If the double tubular knitted fabric is joined from the top to the bottom in this way, the spread of the tubular knitted fabric is limited when the lower end of the outer tubular section is opened, which imposes restriction in design. Furthermore, if the inner tubular section and the outer tubular section are joined at the upper end and the lower end to form a piping, the inside of the piping is not passed through but is blocked in the middle, whereby a rubber band and the like cannot be passed through.

In the knitting method disclosed in patent document 2, the piping is formed in the double tubular structure by folding back the portion at the end of one knitted fabric and joining the loops at the relevant end in the middle of the knitted fabric. In the knitting method disclosed in patent document 2, a completely hollow piping is thereby formed in the tubular knitted fabric, and a rubber band and the like can be passed through. However, according to this method, the lower end of the piping must be formed into a closed state, that is, the inner tubular section and the outer tubular section are connected at the upper end and the lower end, and thus the lower end cannot be opened.

The present invention aims to provide a method of knitting a double tubular knitted fabric in which an outer tubular section can be formed independent from an inner tubular section while knitting the inner and outer tubular sections simultaneously by a flat knitting machine.

Means to Solve the Problem

The present invention provides a method of knitting a double tubular knitted fabric including an inner tubular section and an outer tubular section made up of a front knitted fabric part and a back knitted fabric part, using a flat knitting machine having at least a pair of front and back needle beds extending in a transverse direction and disposed opposite to each other in a cross direction, at least either of which is capable of being racked in the transverse direction so that loops can be transferred between the front and back needle beds.

That is, in the method of knitting the double tubular knitted fabric according to the present invention, each of the front knitted fabric parts of the inner tubular section and the outer tubular section is assigned to one of the front and back needle beds, and each of the back knitted fabric parts of the inner tubular section and the outer tubular section is assigned to the other of the front and back needle beds.

When each of the front knitted fabric parts of the inner tubular section and the outer tubular section is assigned to one of the front and back needle beds, and each of the back knitted fabric parts of the inner tubular section and the outer tubular section is assigned to the other of the front and back needle beds, the back knitted fabric part of the inner tubular section or the back knitted fabric part of the outer tubular section that is not knitted is held on the needles of the other needle bed while knitting the front knitted fabric part of the inner tubular section or the front knitted fabric part of the outer tubular section by the needles of the one needle bed. In knitting the back knitted fabric part of the inner tubular section or the back knitted fabric part of the outer tubular section by the needles of the other needle bed, the front knitted fabric part of the inner tubular section or the front knitted fabric part of the outer tubular section that is not knitted is held on the needles of the one needle bed.

In knitting each of the knitted fabric parts, loops are held on the needles in the following manner. For example, in knitting the front knitted fabric part of the inner tubular section on one needle bed, the front knitted fabric part of the inner tubular section is knitted by the needles of the one needle bed, the loops of the back knitted fabric part of the inner tubular section and the loops of the back knitted fabric part of the outer tubular section are held on the needles of the other needle bed without knitting, and the loops of the front knitted fabric part of the outer tubular section are held on the needles of the one needle bed without knitting.

In knitting the back knitted fabric part of the inner tubular section on the other needle bed, the back knitted fabric part of the inner tubular section is knitted by the needles of the other needle bed, the loops of the front knitted fabric part of the inner tubular section and the loops of the front knitted fabric part of the outer tubular section are held on the needles of the one needle bed without knitting, and the loops of the back knitted fabric part of the outer tubular section are held on the needles of the other needle bed without knitting.

Furthermore, in knitting the front knitted fabric part of the outer tubular section on the one needle bed, all the loops of the front knitted fabric part of the inner tubular section are transferred to and held on empty needles of the opposing other needle bed before knitting, and the front knitted fabric part of the outer tubular section is knitted by the needles of the one needle bed, with the loops of the back knitted fabric part of the outer tubular section and the loops of the front and back knitted fabric parts of the inner tubular section being held on the needles of the other needle bed without knitting.

In knitting the back knitted fabric part of the outer tubular section on the other needle bed, all the loops of the back knitted fabric part of the inner tubular section are transferred to and held on empty needles of the opposing one needle bed before knitting, and the back knitted fabric part of the outer tubular section is knitted by the needles of the other needle bed, with the loops of the front knitted fabric part of the outer tubular section and the loops of the front and back knitted fabric parts of the inner tubular section being held on the needles of the one needle bed without knitting.

According to the present invention, when knitting the double tubular knitted fabric including the inner tubular section and the outer tubular section, knitting can be performed using a two-bed flat knitting machine including a front needle bed and a back needle bed or knitting can be performed using a four-bed flat knitting machine including a lower front needle bed and a lower back needle bed, and an upper front needle bed and an upper back needle bed arranged above the lower needle beds.

When knitting the double tubular knitted fabric using the two-bed flat knitting machine, for example, the front and back knitted fabric parts are knitted by alternately holding the loops of the inner tubular section and the loops of the outer tubular section on the needles at every one empty needle in each of the front and back needle beds. Specifically, in the front needle bed, the order in which a loop of the front knitted fabric part of the outer tubular section, an empty needle, a loop of the front knitted fabric part of the inner tubular section, and an empty needle are in turn, is repeated to hold the loops of each of the knitted fabric parts on the needles. In the back needle bed, the order in which a loop of the back knitted fabric part of the outer tubular section, an empty needle, a loop of the back knitted fabric part of the inner tubular section, and an empty needle are in turn, is repeated to hold the loops of each of the knitted fabric parts on the needle. In this case, each loop is held on the needle such that, when a needle holds a loop, the opposing needle is an empty needle at the opposing needle beds.

In the case that knitting is limited to plain stitch, in each of the front and back needle beds, a loop of the inner tubular section and a loop of the outer tubular section may be held on needles next to each other without an empty needle between them, and after one empty needle, a loop of the inner tubular section and a loop of the outer tubular section may be similarly held on the needles next to each other when alternately holding the loops of the inner tubular section and the loops of the outer tubular section on the needles. Specifically, in the front needle bed, the order in which a loop of the front knitted fabric part of the outer tubular section, a loop of the front knitted fabric part of the inner tubular section, and an empty needle are in turn, is repeated to hold the loops of each knitted fabric part on the needles. In the back needle bed, the order in which a loop of the back knitted fabric part of the outer tubular section, a loop of the back knitted fabric part of the inner tubular section, and an empty needle are in turn, is repeated to hold the loops of each fabric part on the needles. In this case, the needles holding the loops of the front knitted fabric part of the outer tubular section and the needles holding the loops of the back knitted fabric part of the outer tubular section face each other, and the empty needles are arranged on the opposing needle bed with respect to the needles holding the loops of the inner tubular section.

When using the four-bed flat knitting machine, for example, the loops of the front knitted fabric parts of the inner tubular section and the outer tubular section are held on the needles in a state where the empty needle is not present in the lower front needle bed, and the loops of the back knitted fabric parts of the inner tubular section and the outer tubular section are similarly held on the needles in a state where the empty needle is not present in the lower back needle bed to perform the knitting of the front and back knitted fabric parts. The upper back needle bed is used as the empty needles for holding the loops of the front knitted fabric part of the inner tubular section when knitting the front knitted fabric part of the outer tubular section or is used for transferring loops when knitting the front knitted fabric parts of the inner tubular section and the outer tubular section. The needles of the upper front needle bed are used as the empty needles for holding the loops of the back knitted fabric part of the inner tubular section when knitting the back knitted fabric part of the outer tubular section or are used for transferring loops when knitting the back knitted fabric parts of the inner tubular section and the outer tubular section. Furthermore, transfer between the lower front needle bed and the lower back needle bed is also possible.

When using the two-bed flat knitting machine, the knitted fabric may be knitted by arranging a transfer jack bed in which transfer jacks are lined, at the upper part of one or both of the front and back needle beds.

The knitting method of the present invention uses at least two yarn feeders, where the inner tubular section is formed using a yarn from one yarn feeder and the outer tubular section is formed using a yarn from the other yarn feeder by performing return knitting in which a loop is formed subsequent to the loop formed in a going course in a returning course, and connecting the loops at the boundary of the returning part.

In knitting the inner tubular section and in knitting the outer tubular section, the respective yarn feeders are moved such that the yarn for knitting the inner tubular section and the yarn for knitting the outer tubular section do not intersect. Specifically, in knitting the inner tubular section, the yarn feeder for the outer tubular section is moved to a position at which the yarn for knitting the outer tubular section does not intersect the yarn for knitting the inner tubular section. In knitting the outer tubular section, the yarn feeder for the inner tubular section is moved to a position at which the yarn for knitting the inner tubular section does not intersect the yarn for knitting the outer tubular section. Furthermore, in connecting the loops at the boundary of the returning part of the outer tubular section, the yarn feeder for the inner tubular section is moved to a position away from the position of the connecting loops so that the yarn for knitting the inner tubular section does not cross the connecting loops.

In knitting the outer tubular section, the front knitted fabric part of the inner tubular section is transferred to the other opposing needle bed when knitting the front knitted fabric part of the outer tubular section on one needle bed, and the back knitted fabric part of the inner tubular section is transferred to the one needle bed when knitting the back knitted fabric part of the outer tubular section on the other needle bed.

In the knitting method according to the present invention, the inner tubular section and the outer tubular section may be knitted by the following three knitting methods, for example.

In the first knitting method, the outer tubular section is knitted by return knitting from one end side so that the front knitted fabric part and the back knitted fabric part are continuous at one end and opened at the other end side. While return-knitting the outer tubular section, the inner tubular section is knitted into a tubular shape by starting the knitting of the front knitted fabric part or the back knitted fabric part from the other end side so that the knitted fabric parts are connected. Furthermore, while the inner tubular section is being knitted when the yarn feeder for the inner tubular section is not positioned at the other end side, the other end of the outer tubular section is connected by transferring and overlapping the loops at the boundary of the returning part of the front knitted fabric part and the back knitted fabric part. The return knitting of the outer tubular section, the knitting of the inner tubular section into a tubular shape, and the knitting of the connection of the outer tubular section are repeated to knit the outer tubular section and the inner tubular section.

Another knitting method includes knitting the inner tubular section into a tubular shape, return knitting the outer tubular section by returning in the middle of the knitting width of the front knitted fabric part or the back knitted fabric part, and connecting the boundary of the returning part by knitting to form the knitted fabric into a tubular shape, thereby knitting the outer tubular section and the inner tubular section. Connecting the boundary of the returning part by knitting may be by tucking, or by forming loops.

The third knitting method includes knitting the inner tubular section into a tubular shape, and knitting the outer tubular section using two yarn feeders by knitting the front knitted fabric part with a yarn from one yarn feeder and knitting the back knitted fabric part with a yarn from the other yarn feeder, and forming the knitted fabric into a tubular shape by overlapping the loops at both ends of the front knitted fabric part of the outer tubular section with the loops at both ends of the opposing back knitted fabric part of the outer tubular section, thereby knitting the outer tubular section and the inner tubular section.

In the method of knitting the double tubular knitted fabric according to the present invention, all the loops at the upper end of the outer tubular section and the loops of the inner tubular section can be overlapped and joined. In this manner, the upper end of the outer tubular section and the inner tubular section are joined to enable seamless joining, and the outer tubular section can be joined at a desired position of the inner tubular section.

By knitting the tubular knitted fabric by the above knitting method, there is provided a double tubular knitted fabric including the outer tubular section and the inner tubular section respectively set up and independently knitted in a seamless manner, where the outer tubular section is knitted by return-knitting so as to be connected at at least one location to form a tubular shape, a yarn for knitting the inner tubular section and a yarn for knitting the outer tubular section do not intersect each other, and the upper end of the outer tubular section is joined with the inner tubular section in a seamless manner, and the lower end on a set up side of the outer tubular section is opened. Therefore, the outer tubular section may not be joined to the inner tubular section in the vertical direction of the tubular fabric.

Moreover, when joining the upper end of the outer tubular section and the inner tubular section in the above manner, the lower ends of the outer tubular section and the inner tubular section may be opened. In order to open the lower ends of the outer tubular section and the inner tubular section, a draw thread is used at the set up of the outer tubular section to start knitting in a state joined to the inner tubular section, and removing the draw thread after the upper end of the outer tubular section is joined to the inner tubular section, so that the lower end of the outer tubular section is opened.

In joining the upper end of the outer tubular section and the inner tubular section in the above manner, the lower ends of the outer tubular section and the inner tubular section may be joined at set up. By such knitting, a piping that passes through in the peripheral direction of the tubular part can be formed by the inner tubular section and the outer tubular section.

Furthermore, the inner tubular section is preferably knitted using a yarn having a thermal contraction coefficient larger than that of the yarn for knitting the outer tubular section. In the knitted fabrics of the inner tubular section, when the yarn having a large thermal contraction coefficient is used for the inner tubular section, the loops are closely packed and the knitted fabric also contracts in the vertical direction by performing heat process on the knitted fabric. Consequently, the outer tubular section will have a diameter larger than the inner tubular section and will be long in the vertical direction. As a result, when the upper end of the outer tubular section is joined to the inner tubular section and the lower end is opened, the outer tubular section can be formed into frills.

The inner tubular section and the outer tubular section may be knitted so that the loop length of the knitted fabrics of the inner tubular section and the loop length of the knitted fabrics of the outer tubular section are different. The knitted fabrics having different texture for inner tubular section and the outer tubular section may be formed by having different loop lengths.

Effect of the Invention

According to the method of knitting a double tubular knitted fabric of the present invention, the outer tubular section and the inner tubular section do not intersect in the knitting width direction, and thus one part of the outer tubular section does not continuously join in the vertical direction (direction of length of tube) with respect to the inner tubular section even if the inner tubular section and the outer tubular section are simultaneously knitted. As a result, the outer tubular section is formed as a tubular knitted fabric independent from the inner tubular section, and the outer tubular section may be knitted with a larger diameter with respect to the inner tubular section or the inner tubular section and the outer tubular section may be knitted so as to have different tube lengths, whereby the freedom of design by the outer tubular section can be expanded.

BEST MODE FOR CARRYING OUT THE INVENTION

Preferred embodiments of the present invention will now be described in detail with reference to the drawings. The knitted fabric is knitted using a so-called four-bed flat knitting machine in the first embodiment to the third embodiment. The four-bed flat knitting machine includes an lower front needle bed FD and an lower back needle bed BD, and an upper front needle bed FU and an upper needle bed BU arranged above the lower needle beds, in which a large number of knitting needles are lined at the same pitch as in the lower needle beds.

Each embodiment below describes a case of knitting the inner tubular section and the outer tubular section by plain stitch. By using the four-bed flat knitting machine, the front knitted fabric parts of the inner and the outer tubular sections are knitted with the lower front needle bed FD, and the back knitted fabric parts of the inner tubular section and the outer tubular section are knitted with the lower back needle bed BD.

In other words, the front knitted fabric parts are knitted with the needle of the lower front needle bed FD when knitting the front knitted fabric part of the inner tubular section or of the outer tubular section, and the back knitted fabric parts are knitted with the needle of the lower back needle bed BD when knitting the back knitted fabric part of the inner tubular section or of the outer tubular section.

The needles of the upper back needle bed BU are used as empty needles for holding the loops of the front knitted fabric part of the inner tubular section while knitting the front knitted fabric part of the outer tubular section, or are used for transferring while knitting the front knitted fabric parts of the inner tubular section and of the outer tubular section. The needles of the upper front needle bed FU are used as empty needles for holding the loops of the back knitted fabric part of the inner tubular section while knitting the back knitted fabric part of the outer tubular section, or are used for transferring while knitting the back knitted fabric parts of the inner tubular section and of the outer tubular section.

By using the empty needles of the upper front needle bed FU and of the upper back needle bed BU, structure patterns in which the front stitch and the back stitch are mixed such as links, purls and ribs can be knitted, or the front and back loops can be moved in the knitting width direction to be joined with each other.

Furthermore, the knitted fabric of the inner tubular section is knitted using the even-numbered needles of the front and back needle beds, and the knitted fabric of the outer tubular section is knitted using the odd-numbered needles of the front and back needle beds.

First Embodiment

A method of knitting a double tubular knitted fabric according to a first embodiment will now be described with reference to FIGS. 1 to 3. FIG. 1 is an explanatory view showing an outline of a knitting procedure of the inner tubular section and the outer tubular section in the first embodiment. FIG. 2 is a knitting process drawing of knitting the inner tubular section and the outer tubular section, and FIG. 3 is a knitting process drawing of joining the upper end of the outer tubular section with the inner tubular section.

In the knitting process drawings (FIG. 2 to FIG. 5) used in the first embodiment and the second embodiment, the numbers on the left side indicate the step numbers, FU refers to the upper front needle bed, FD refers to the lower front needle bed, BD refers to the lower back needle bed, and BU refers to the upper back needle bed. The arrows above the step numbers on the left side in FIG. 3 indicate the racking direction of the back needle bed.

In the first embodiment and the second embodiment, the inner tubular section and the outer tubular section are knitted using two yarn feeders. In the knitting process drawings (FIG. 2 to FIG. 5), the numbers in triangle at the right side indicate the yarn feeder, where yarn feeder (1) is the yarn feeder for knitting the inner tubular section, and the yarn feeder (2) is the yarn feeder for knitting the outer tubular section.

In the first embodiment, the outer tubular section 1 is return-knitted by C-shaped knitting from one end (left end of FIG. 1) such that the front knitted fabric part 11 and the back knitted fabric part 12 are continuous at one end and are opened at the other end. The return knitting repeats the operation of knitting the back knitted fabric part 12 from the left end of FIG. 1 on the lower back needle bed BD, returning and knitting the back knitted fabric part 12 again, knitting the front knitted fabric part 11 from the left end of FIG. 1 on the lower front needle bed FD, and returning and knitting the front knitted fabric part 11 again. In the outer tubular section 1, the loops at the ends on the other end of the front knitted fabric part 11 and of the back knitted fabric part 12 (loops at the boundary of the returning part) face each other on the lower front needle bed FD and the lower back needle bed BD.

While return-knitting the outer tubular section 1, in the inner tubular section 2, knitting starts from the other end (right end of FIG. 1) of the back knitted fabric part 22 on the lower back needle bed BD, the front knitted fabric part 21 on the lower front needle bed FD, to the back knitted fabric part 22, and by repeatedly performing this circling-knitting, the inner tubular section 2 is formed into a tubular shape.

Regarding the outer tubular section 1, when the yarn feeder (1) for knitting the inner tubular section 2 is not positioned at the other end, that is, when the back knitted fabric part 22 is knitted and the yarn feeder (1) is positioned at the left end of FIG. 1 while knitting the inner tubular section 2, the loops at the end of the front knitted fabric part 11 and the back knitted fabric part 12 forming the outer tubular section 1 are overlapped through transferring and knitted to connect the other end of the outer tubular section 1. After such connection knitting is completed, the front knitted fabric part 21 of the inner tubular section 2 is knitted.

Therefore, in the present embodiment, the outer tubular section 1 and the inner tubular section 2 are knitted simultaneously by repeating the knitting of the inner tubular section 2 and the outer tubular section 1, and the knitting for connecting the other end of the outer tubular section 1.

The circled numbers shown in FIG. 1 indicate the order of knitting. Circled numbers 1 to 4 indicate the knitting steps of the outer tubular section 1, the circled numbers 5, 6, 7, and 9 indicate the knitting steps of the inner tubular section 2, and the circled number 8 indicates the step of overlapping the loops at the end in the outer tubular section 1.

The knitting method according to the first embodiment will now be specifically described with reference to FIGS. 2 and 3. The present embodiment shows a case of starting the knitting of the outer tubular section in the middle of knitting the inner tubular section 2, where a draw thread is fed to the needles between the needles holding the loops of the inner tubular section 2 to perform set up. This set up can be performed by a known method (set up, interlock etc.). Following the set up by the draw thread, the yarn is fed from the yarn feeder (2) to form the loops of the outer tubular section 1. In this case, the front knitted fabric part 21 of the inner tubular section 2 formed on the lower front needle bed FD is transferred to the opposing upper back needle bed BU when forming the loops of the outer tubular section on the lower front needle bed FD, whereas the back knitted fabric part 22 of the inner tubular section 2 formed on the lower back needle bed BD is transferred to the opposing upper front needle bed FU when forming the loops of the outer tubular section 1 on the lower back needle bed BD.

The state in which the loops of the inner tubular section 2 and the loops of the outer tubular section 1 are held on the lower front needle bed FD and on the lower back needle bed BD is shown in step S of FIG. 2.

From the state of step S, the loops of the back knitted fabric part 22 of the inner tubular section 2 knitted on the lower back needle bed BD are transferred to the opposing upper front needle bed FU (step 1).

Next, the yarn is fed from the yarn feeder (2) while moving the yarn feeder (2) to the right to knit one course of the back knitted fabric part 12 of the outer tubular section 1 on the lower back needle bed BD (step 2). The last loop (loop on the right end in FIG. 2) in the one course of knitting is knitted with an empty needle, and a widening loop is formed by the empty needle knitting. The loops formed by the empty needle knitting become the loops for connecting the outer tubular section 1 into a tubular shape. Subsequently, the yarn is fed from the yarn feeder (2) while moving the yarn feeder (2) to the left to knit one course of the back knitted fabric part 12 of the outer tubular section 1 on the lower back needle bed BD (step 3).

After returning the back knitted fabric part 22 of the inner tubular section 2 transferred to the upper front needle bed FU to the original lower back needle bed BD, the loops of the front knitted fabric part 21 of the inner tubular section 2 held on the lower front needle bed FD are transferred to the opposing upper back needle bed BU (step 4).

Next, the yarn is fed from the yarn feeder (2) while moving the yarn feeder (2) to the right to knit one course of the front knitted fabric part 11 of the outer tubular section 1 on the lower front needle bed FD (step 5). Subsequently, the yarn is fed from the yarn feeder (2) while moving the yarn feeder (2) to the left to knit one course of the front knitted fabric part 11 of the outer tubular section 1 on the lower front needle bed FD (step 6). The return-knitting (C-shaped knitting) by the knitting of going and returning courses of the back knitted fabric part and the knitting of the going and returning courses of the front knitted fabric part of the outer tubular section 1 is thereby performed from step 2 to step 6.

The front knitted fabric part 21 of the inner tubular section 2 transferred to the upper back needle bed BU is then returned to the original lower front needle bed FD (step 7) to proceed to the circling-knitting of the inner tubular section 2. In the knitting of the inner tubular section 2, the yarn is fed from the yarn feeder (1) while moving the yarn feeder (1) to the left to knit one course of the back knitted fabric part 22 of the inner tubular section 2 on the lower back needle bed BD (step 8). Subsequently, the yarn is fed from the yarn feeder (1) while moving the yarn feeder (1) to the right to knit one course of the front knitted fabric part 21 of the inner tubular section 2 on the lower front needle bed FD (step 9). The yarn is then fed from the yarn feeder (1) while moving the yarn feeder (1) to the left to knit one course of the back knitted fabric part 22 of the inner tubular section 2 on the lower back needle bed BD (step 10).

The loop (loop knitted by empty needle) for connecting the end in the knitting width of the back knitted fabric part 12 of the outer tubular section 1 formed in step 2 is overlapped with the loop at the end in the knitting width of the front knitted fabric part 11 of the outer tubular section 1 held on the lower front needle bed FD (step 11). Due to the formation of the double loops, the outer tubular section 1 becomes one continuous tubular shape. In forming the double loops, the yarn feeder (1) is positioned at the end in the knitting width on the side opposite to the double loop side, and thus the yarn for knitting the outer tubular section 1 and the yarn for knitting the inner tubular section 2 do not intersect.

Following the step of forming the double loops, the yarn is fed from the yarn feeder (1) while moving the yarn feeder (1) to the right to knit one course of the front knitted fabric part 21 of the inner tubular section 2 on the lower front needle bed FD (step 12 of FIG. 3). The inner tubular section 2 is circling-knitted for two courses through steps 8 to 10 and step 12.

After the knitting of step 12 is completed, the state of step 13 is obtained, where the steps of step 1 to step 12 are repeated until the length of the tube of the outer tubular section 1 becomes a predetermined length in the present embodiment.

After the outer tubular section 1 is knitted to the predetermined length, the process proceeds to the step of joining the upper end of the outer tubular section 1 with the inner tubular section 2. The joining step is shown in step 14 to step 24 of FIG. 3.

First, all the loops of the front knitted fabric parts 21, 11 of the inner tubular section 2 and the outer tubular section 1 held on the lower front needle bed FD are transferred to the opposing upper back needle bed BU (step 14), and the back needle bed is racked by one pitch to the left (step 15). Only the loops of the outer tubular section 1 held on the upper back needle bed BU are returned to the needles of the opposing lower front needle bed FD (step 16), and the back needle bed is racked by one pitch to the right (step 17). All the loops of the front knitted fabric part 21 of the inner tubular section 2 held on the upper back needle bed BU are transferred to the opposing lower front needle bed FD (step 18). The loops of the front knitted fabric parts 21, 11 of the inner tubular section 2 and the outer tubular section 1 are in an overlapping state as a result of step 18.

All the loops of the back knitted fabric parts 22, 12 of the inner tubular section 2 and the outer tubular section 1 held on the lower back needle bed BD are transferred to the opposing upper front needle bed FU (step 19), and the back needle bed is racked by one pitch to the right (step 20). Only the loops of the outer tubular section 1 held on the upper front needle bed FU are returned to the needles of the opposing lower back needle bed BD (step 21), and the back needle bed is racked by one pitch to the left (step 22). All the loops of the back knitted fabric part 22 of the inner tubular section 2 held on the upper front needle bed FU are transferred to the opposing lower back needle bed BD (step 23). The loops of the back knitted fabric parts 22, 12 of the inner tubular section 2 and the outer tubular section 1 are in an overlapping state as a result of step 23.

At the end of step 23, two loops are held by one needle at each needle bed, as shown in step 24. Subsequent to step 24, a loop is formed on the two loops so that the outer tubular section 1 is joined to the inner tubular section 2. After knitting the inner tubular section and the outer tubular section, the draw thread used in setting up of the outer tubular section 1 is drawn, so that the lower end of the outer tubular section 1 is opened from the inner tubular section 2 and the outer tubular section 1 has only the upper end joined with the inner tubular section. A knitted fabric can be obtained by repeating the above-described knitting.

Furthermore, in the first embodiment, the yarn that heat contracts greatly by heating is used for the yarn for knitting the inner tubular section 2, and natural fiber such as cotton having a small thermal contraction coefficient is used for the yarn for knitting the outer tubular section 1. Thus, the yarn of the inner tubular section 2 heat contracts by performing heat process on the double tubular knitted fabric after knitting is completed, whereby the loops become closely packed, and the inner tubular section 2 have the knitted fabric contracted in the vertical, and horizontal directions. On the contrary, since the outer tubular section 1 does not contract, the outer tubular section 1 is in a flared state as shown in FIG. 7(*a*) or in a multi-stage frilled state as shown in FIG. 7(*b*). FIG. 7 shows a skirt knitted by the above knitting, where FIG. 7(*a*) shows a double-layered skirt having the hem in an open state, and FIG.

7(*b*) shows a skirt in which the multi-stage frills are formed by repeating the above knitting a plurality of times. Furthermore, since the loop lengths of the knitted fabric are different in the inner tubular section 2 and in the outer tubular section 1 due to heat process, the texture of the inner tubular section 2 and the outer tubular section 1 can be made different.

Second Embodiment

A method of knitting a double tubular knitted fabric according to a second embodiment will now be described based on the knitting process drawing shown in FIGS. 4 and 5. The inner tubular section 2 is circling-knitted, and the outer tubular section 1 is knitted into a tubular shape while connecting the middle of the back knitted fabric part as in intarsia fabric. In other words, the inner tubular section 2 is circling-knitted while the outer tubular section 1 is return knitted by C-shaped knitting as connecting by tucking at the middle part in the knitting width of the back knitted fabric part 12 held on the lower back needle bed BD to form a continuous knitted fabric of tubular shape, whereby the outer tubular section 1 and the inner tubular section 2 are knitted simultaneously. In the second embodiment, the yarn feeder for knitting the inner tubular section is on the far side of the yarn feeder for knitting the outer tubular section so that the yarn for knitting the inner tubular section and the yarn for knitting the outer tubular section do not intersect.

The knitting method of the second embodiment will now be specifically described with reference to FIGS. 4 and 5. The same operation as the first embodiment is performed for set up in the present embodiment, and thus the description thereof will be omitted.

From the state of step S, the yarn is fed from the yarn feeder (1) while moving the yarn feeder (1) to the right to knit one course of the front knitted fabric part 21 of the inner tubular section 2 on the lower front needle bed FD (step 1). All the loops of the inner tubular section 2 knitted in step 1 are transferred to the needles of the opposing upper back needle bed BU (step 2). The yarn is then fed from the yarn feeder (2) while moving the yarn feeder (2) to the right to knit one course of the front knitted fabric part 11 of the outer tubular section 1 on the lower front needle bed FD (step 3). All the loops of the front knitted fabric part 21 of the inner tubular section 2 held on the upper back needle bed BU are returned to the lower front needle bed FD (step 4).

The yarn is fed from the yarn feeder (1) while moving the yarn feeder (1) to the left to knit one course of the back knitted fabric part 22 of the inner tubular section 2 on the lower back needle bed BD (step 5). All the loops of the inner tubular section 2 knitted in step 5 are transferred to the needles of the opposing upper front needle bed FU (step 6).

The yarn is then fed from the yarn feeder (2) while moving the yarn feeder (2) to the left to knit one course of only the right half in FIG. 4 of the back knitted fabric part 12 of the outer tubular section 1 on the lower back needle bed BD (step 7). Subsequently, the yarn is fed from the yarn feeder (2) while moving the yarn feeder (2) to the right to knit one course of only the right half in FIG. 4 of the back knitted fabric part 12 of the outer tubular section 1 on the lower back needle bed BD (step 8). In step 8, tucking is performed at the outer side of a loop formed in step 7 to connect the back knitted fabric part 12.

After returning all the loops of the back knitted fabric part 22 of the inner tubular section 2 held on the upper front needle bed FU to the lower back needle bed BD, all the loops of the front knitted fabric part 21 of the inner tubular section 2 held on the lower front needle bed FD are transferred to the upper back needle bed BU (step 9).

The yarn is fed from the yarn feeder (2) while moving the yarn feeder (2) to the left to knit one course of the front knitted fabric part 11 of the outer tubular section 1 on the lower front needle bed FD (step 10).

All the loops of the front knitted fabric part 21 of the inner tubular section 2 held on the upper back needle bed BU are returned to the lower front needle bed FD (step 11), and the yarn is fed from the yarn feeder (1) while moving the yarn feeder (1) to the right to knit one course of the front knitted fabric part 21 of the inner tubular section 2 on the lower front needle bed FD (step 12).

All the loops of the back knitted fabric part 22 of the inner tubular section 2 held on the lower back needle bed BD are transferred to the upper front needle bed FU (step 13).

The yarn is fed from the yarn feeder (2) while moving the yarn feeder (2) to the right to knit one course of only the left half in FIG. 4 of the back knitted fabric part 12 of the outer tubular section 1 on the lower back needle bed BD (step 14). Subsequently, the yarn is fed from the yarn feeder (2) while moving the yarn feeder (2) to the left to knit one course of only the left half in FIG. 4 of the back knitted fabric part 12 of the outer tubular section 1 on the lower back needle bed BD (step 15). In step 15, tucking is performed at the outer side of a loop formed in step 14 to connect the back knitted fabric part 12. The outer tubular section 1 thus becomes a tubular shape by the tuck connecting in step 8 and step 15. Tucking may be performed in both step 8 and step 15 or may be performed in either one of the steps. Furthermore, the outer tubular section may be connected by knitting instead of by tucking. Moreover, the yarn of the yarn feeder (1) and the yarn of the yarn feeder (2) do not intersect since the yarn feeder (1) is arranged on the right end while performing knitting of step 14 and step 15.

After step 15, all the loops of the back knitted fabric part 22 of the inner tubular section 2 held on the upper front needle bed FU are returned to the lower back needle bed BD (step 16), and the yarn is fed from the yarn feeder (1) while moving the yarn feeder (1) to the left to knit one course of the back knitted fabric part 22 of the inner tubular section 2 on the lower back needle bed BD (step 17).

The processes of step 1 to step 17 are repeated until the length of the tube of the outer tubular section 1 becomes a predetermined length. When the outer tubular section 1 is knitted to the predetermined length, the process proceeds to the process of joining the upper end of the outer tubular section 1 with the inner tubular section 2. The joining process is the same process as the process shown in step 14 to step 24 of FIG. 3 in the first embodiment.

Effects of the first embodiment and other effects can be provided to the knitted fabric by knitting with yarns of different materials for knitting the inner tubular section 2 and for knitting the outer tubular section 1 in the second embodiment.

In the second embodiment as well, the draw thread used in setting up of the outer tubular section 1 is drawn after joining of the inner tubular section 2 and the outer tubular section 1 is completed, so that the lower end of the outer tubular section 1 is opened from the inner tubular section 2 and the outer tubular section 1 has only the upper end joined with the inner tubular section.

Third Embodiment

A method of knitting a double tubular knitted fabric of a third embodiment will now be described based on the knitting schematic view in FIG. 6. In the third embodiment, the inner tubular section 2 is circling-knitted with the yarn fed from the yarn feeder (1), and the outer tubular section 1 is knitted in a manner that the front knitted fabric part 11 is knitted with the yarn fed from the yarn feeder (2) and the back knitted fabric part 12 is knitted with the yarn fed from the yarn feeder (3). In the outer tubular section 1, the loops at both ends of the front knitted fabric part 11 and the opposing loops at both ends of the back knitted fabric part 12 are overlapped by transferring to connect the outer tubular section 1 into a tubular shape.

When joining both ends of the front and back fabric parts of the outer tubular section 1, the yarn feeder (1) for knitting the inner tubular section is arranged at a position where the yarn for knitting the inner tubular section does not intersect the loops to be transferred.

The double layered skirt or skirt with multi-stage frills as shown in FIG. 7 can be formed in the second embodiment and the third embodiment as well, similar to the first embodiment.

In each of the above embodiments, the lower end of the outer tubular section 1 is opened with respect to the inner tubular section 2 by using the draw thread, but set up may be carried out with the yarn for knitting the outer tubular section 1 without using the draw thread. If set up is carried out in this manner, the lower end of the outer tubular section 1 may also be joined with the inner tubular section 2, whereby a piping structure is formed by the inner tubular section 2 and the outer tubular section 1.

Furthermore, in each of the above embodiments, the inner tubular section 2 is circling-knitted to be knitted into a tubular shape, but the inner tubular section 2 may also be knitted by return-knitting as with the outer tubular section 1 and the loops may be connected at the boundary of the returning part.

INDUSTRIAL APPLICABILITY

The knitting method according to the present invention is suitable for, for example, joining a tubular knitted fabric for forming frills to the outer side of one tubular knitted fabric to knit the double tubular knitted fabric.

Figure 1:
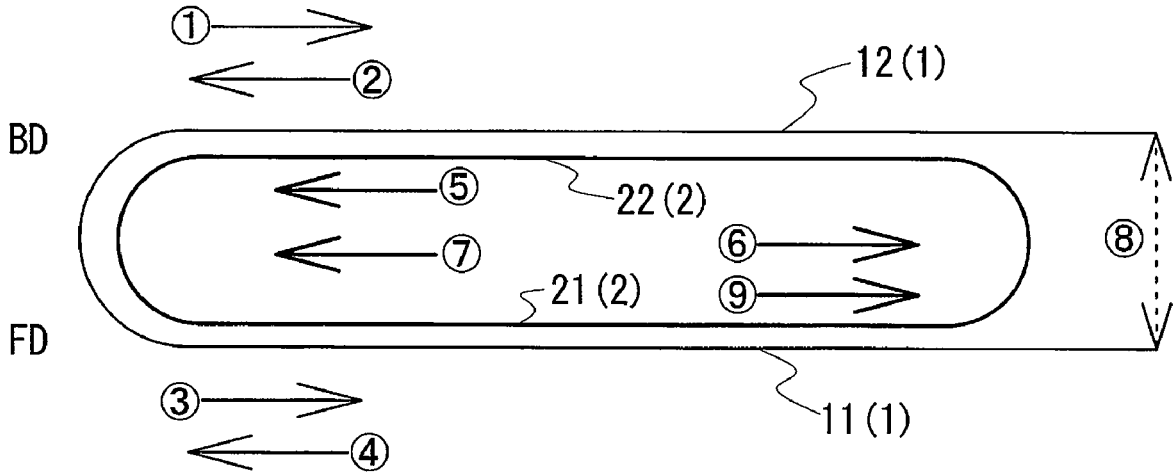
FIG. 1 is a schematic knitting diagram of a method of knitting a fabric according to a first embodiment of the present invention.
Figure 2:
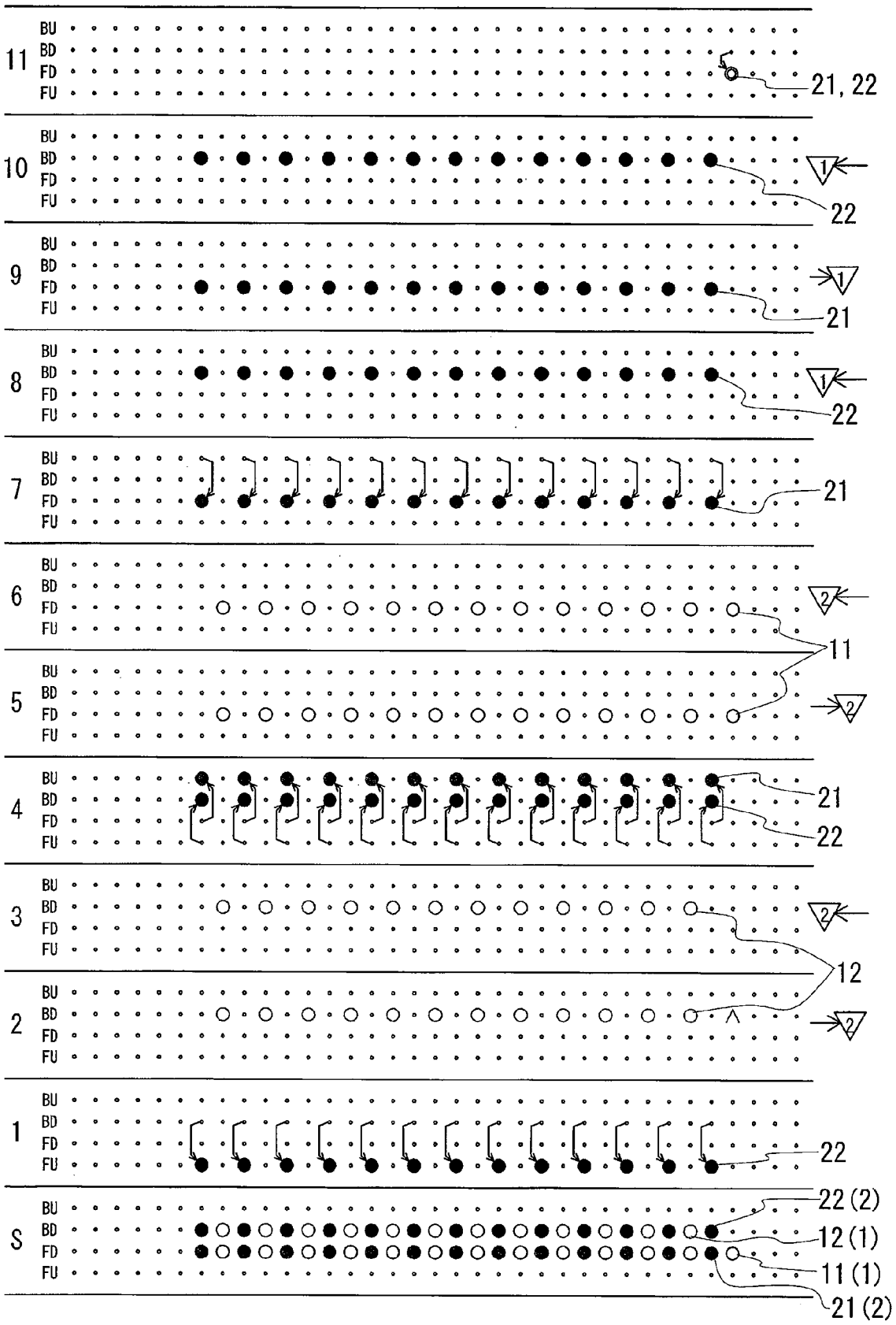
FIG. 2 is a knitting process drawing of knitting the inner tubular section and the outer tubular section in the first embodiment.
Figure 3:
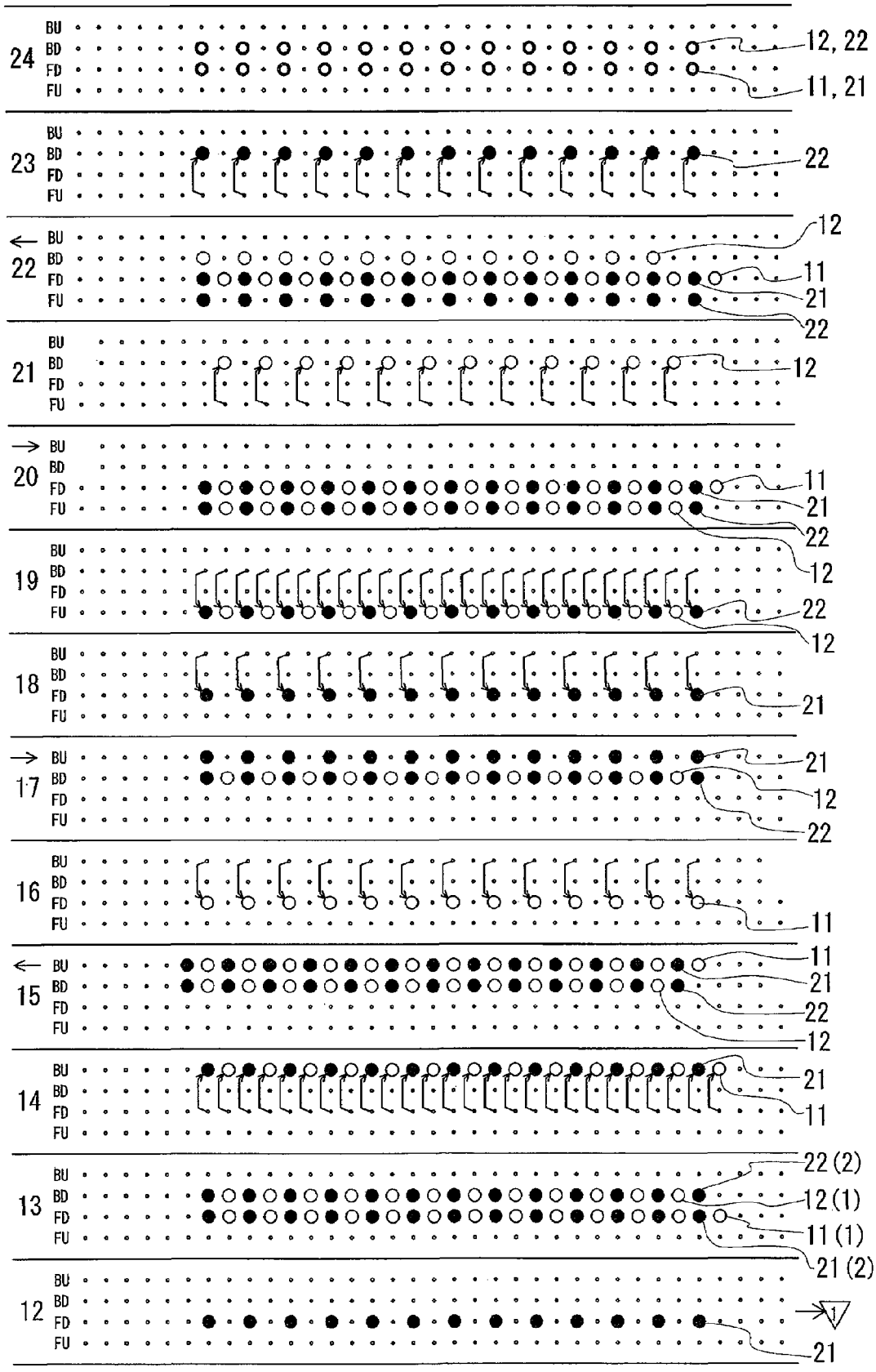
FIG. 3 is a knitting process drawing of joining the outer tubular section with the inner tubular section in the first embodiment.
Figure 4:
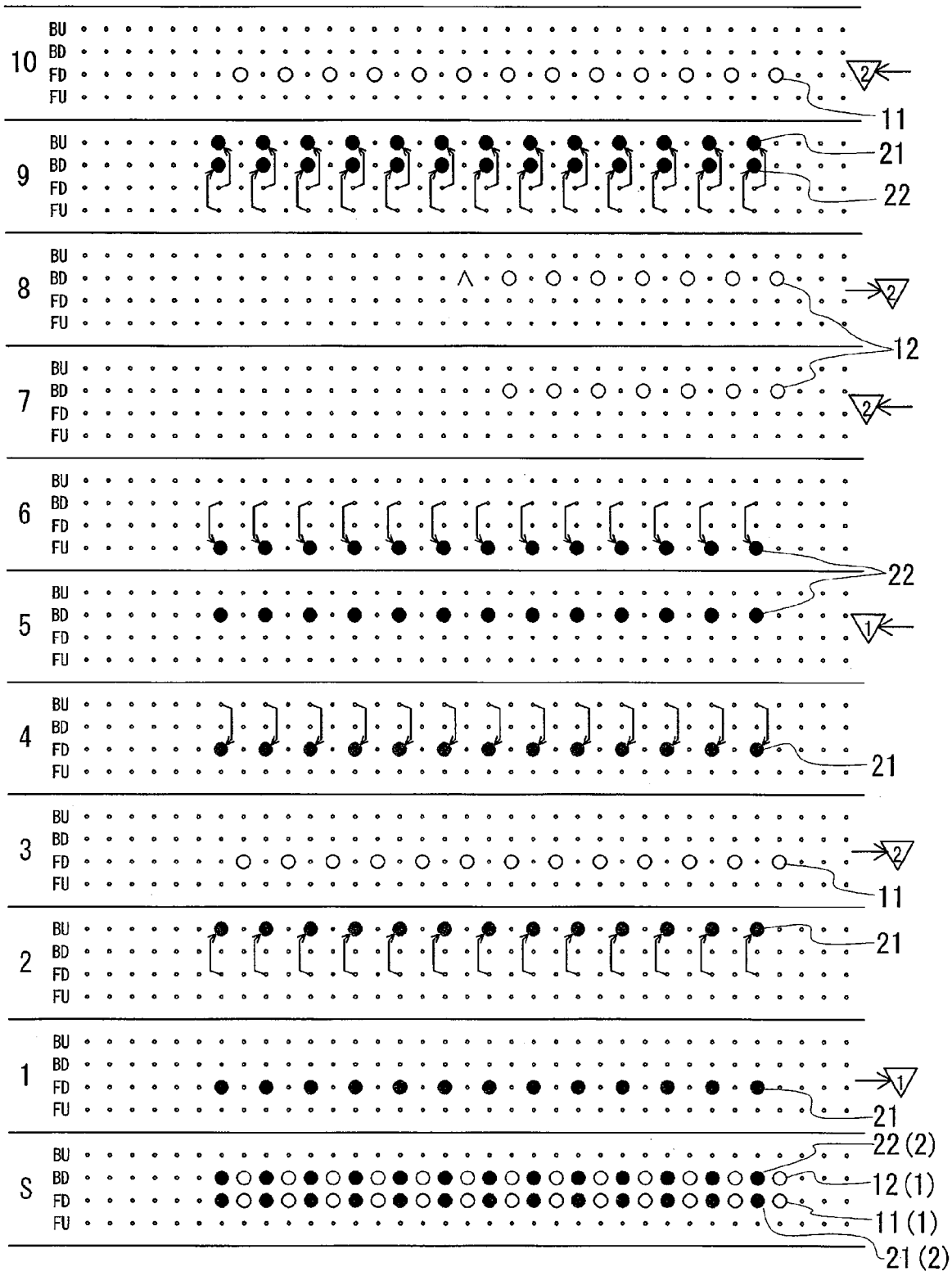
FIG. 4 is a knitting process drawing of knitting the inner tubular section and the outer tubular section in a second embodiment.
Figure 5:
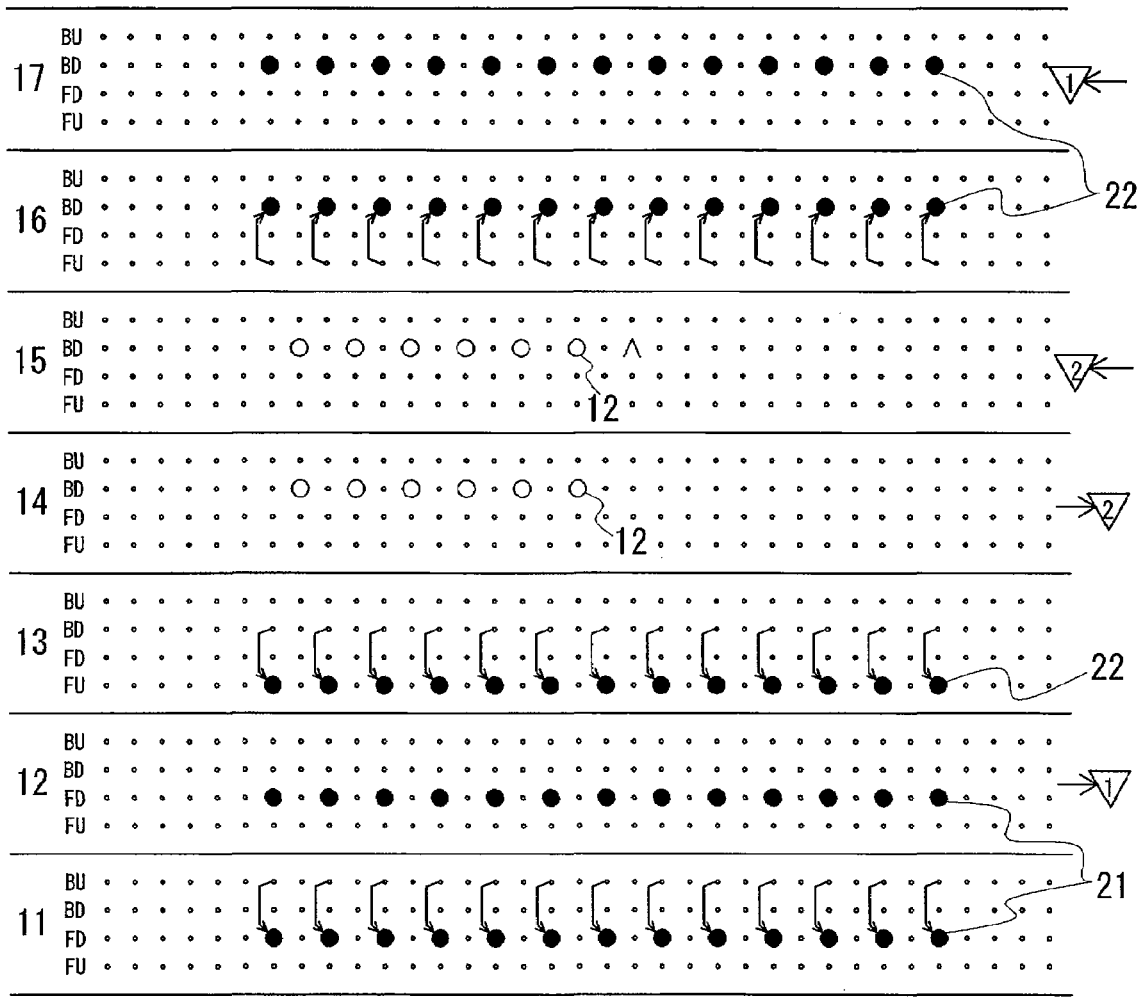
FIG. 5 is a knitting process drawing of knitting the inner tubular section and the outer tubular section in the second embodiment.
Figure 6:
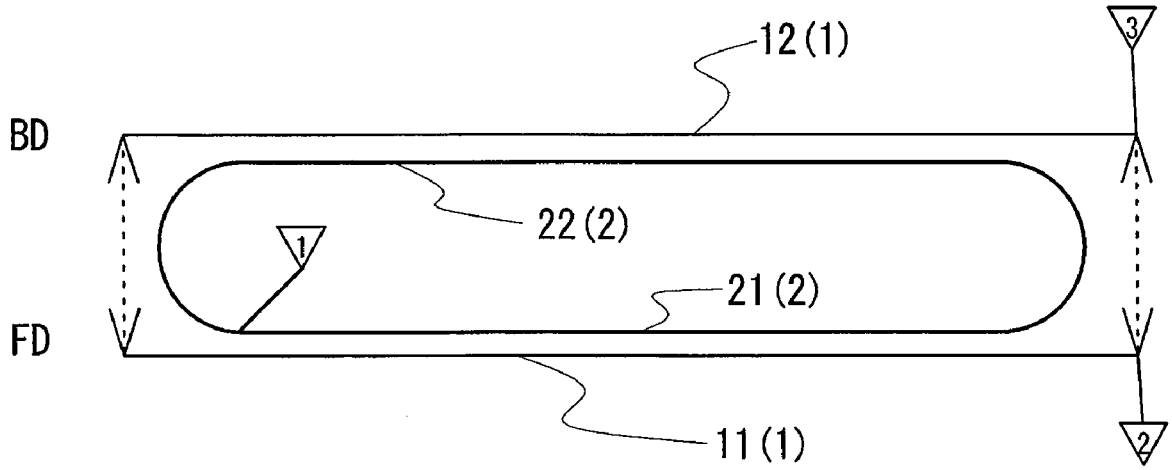
FIG. 6 is a schematic knitting diagram of a method of knitting a fabric according to a third embodiment.
Figure 7A:
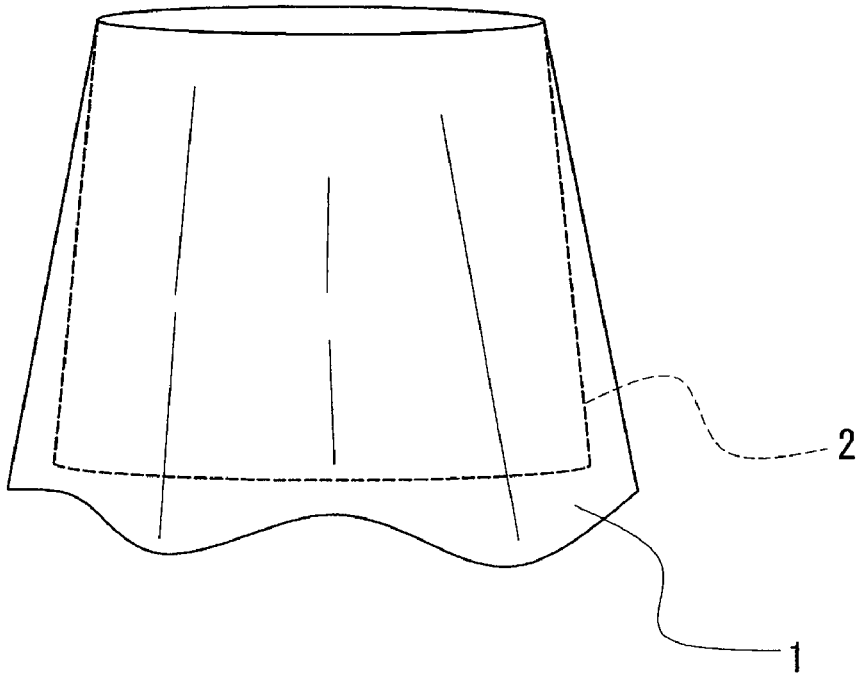
FIG. 7 is a schematic view of a double layered skirt and a skirt with multi-stage frills knitted by the knitting method according to the present invention.
Figure 7B:
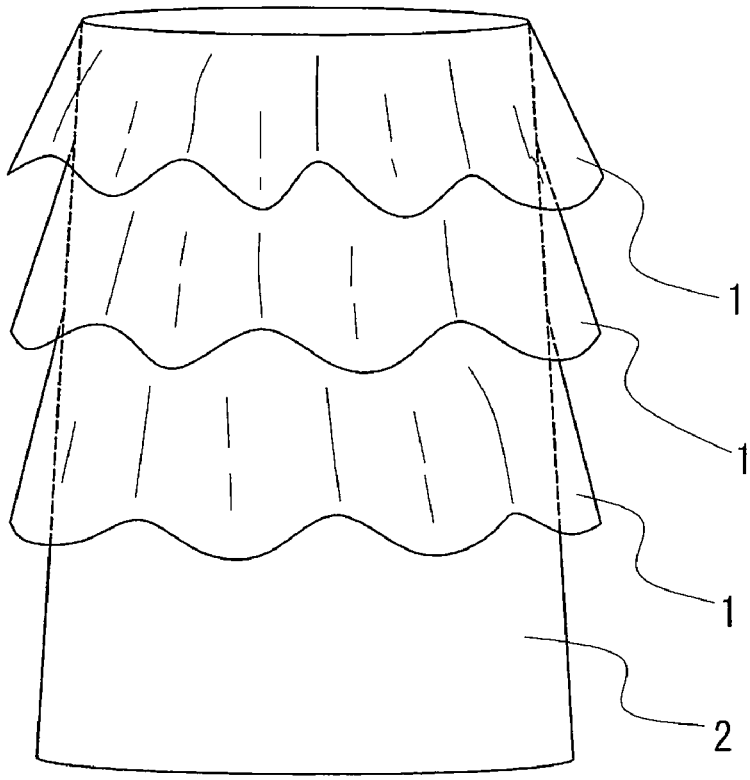

The invention claimed is:

1. A method of knitting a double tubular knitted fabric including an inner tubular section and an outer tubular section made up of a front knitted fabric part and a back knitted fabric part, using a flat knitting machine having at least a pair of front and back needle beds extending in a transverse direction and disposed opposite to each other in a cross direction, at least either of the front or back needle bed being capable of being racked in the transverse direction so that loops can be transferred between the front and back needle beds, the method comprising steps of:

forming the inner tubular section using a yarn fed from one of at least two yarn feeders; and forming the outer tubular section using a yarn from another yarn feeder of the at least two yarn feeders by return-knitting in which loops are formed continuous in a returning course with the loops formed in a going course, and connecting the loops to each other at the boundary of the returning part so as to form a tubular shape, wherein the front knitted fabric part of the inner tubular section is transferred to the other opposing needle bed while knitting the front knitted fabric part of the outer tubular section on one needle bed, and the back knitted fabric part of the inner tubular section is transferred to the one opposing needle bed while knitting the back knitted fabric part of the outer tubular section on the other needle bed;

wherein each of the front knitted fabric parts of the inner tubular section and the outer tubular section is assigned to either one of the front and back needle beds, and each of the back knitted fabric parts of the inner tubular section and the outer tubular section is assigned to the other of the front and back needle beds, and the respective yarn feeders are moved when knitting the inner tubular section and the outer tubular section such that the yarn for knitting the inner tubular section and the yarn for knitting the outer tubular section do not intersect.

2. The method of knitting the double tubular knitted fabric according to claim 1, wherein the following knittings are repeated to knit the outer tubular section and inner tubular section;

knitting the outer tubular section from one end by return-knitting in which the front knitted fabric part and back knitted fabric part are continuous at one end side and opened at the other end side;

knitting the inner tubular section into a tubular shape in which knitting of the front knitted fabric part or the back knitted fabric part is started from the other end side while knitting the outer tubular section; and connection knitting the other end side of the outer tubular section by transferring and overlapping loops at the boundary of the returning part of the front knitted fabric part and the back fabric part of the outer tubular section when the yarn feeder for the inner tubular section is not positioned on the other end side while knitting the inner tubular section into a tubular shape.

3. The method of knitting the double tubular knitted fabric according to claim 1, wherein the outer tubular section is knitted by return-knitting in which knitting is returned in the middle of the knitting width of the front knitted fabric part or the back knitted fabric part and the boundary of the returning part is connected by knitting to form the knitted fabric into a tubular shape, thereby knitting the outer tubular section and the inner tubular section.

4. The method of knitting the double tubular knitted fabric according to claim 1, wherein the outer tubular section is knitted using two yarn feeders to return-knit the front knitted fabric part with a yarn from one yarn feeder and return-knit the back knitted fabric part with a yarn from the other yarn feeder, and the loops at both ends of the front knitted fabric part of the outer tubular section is overlapped with the loops at both ends of the opposing back knitted fabric part to form the fabric into a tubular shape, thereby knitting the outer tubular section and the inner tubular section.

5. The method of knitting the double tubular knitted fabric according to claim 1, wherein the loops at the upper end of the outer tubular section and the loops of the inner tubular section are overlapped and joined.

6. The method of knitting the double tubular knitted fabric according to claim 1, wherein the outer tubular section and the inner tubular section are formed by overlapping and joining the loops at the upper end of the outer tubular section and the loops of the inner tubular section, and opening the lower end.

7. The method of knitting the double tubular knitted fabric according to claim 1, wherein the outer tubular section and the inner tubular section are formed by overlapping and joining the loops at the upper end of the outer tubular section and the loops of the inner tubular section, and joining the lower end at set up.

8. The method of knitting the double tubular knitted fabric according to claim 1, wherein the inner tubular section is knitted using a yarn having a thermal contraction coefficient larger than that of the yarn for knitting the outer tubular section.

9. The method of knitting the double tubular knitted fabric according to claim 1, wherein the inner tubular section and the outer tubular section are knitted so that the loop length of the knitted fabric of the inner tubular section and the loop length of the knitted fabric of the outer tubular section are different.

10. A double tubular knitted fabric including an outer tubular section and an inner tubular section respectively set up and independently knitted in a seamless manner; wherein the outer tubular section is connected at at least one location to form a tubular shape by return knitting;

a yarn for knitting the inner tubular section and a yarn for knitting the outer tubular section do not intersect each other;

the upper end of the outer tubular section is joined with the inner tubular section in a seamless manner; and the lower end of the outer tubular section on a set up side of the outer tubular sections is opened.

* * * * *